US011732545B2

(12) United States Patent
Pirayeh Gar et al.

(10) Patent No.: US 11,732,545 B2
(45) Date of Patent: Aug. 22, 2023

(54) RADIALLY EXPANDABLE ANTI-EXTRUSION BACKUP RING

(71) Applicant: HALLIBURTON ENERGY SERVICES, INC., Houston, TX (US)

(72) Inventors: Shobeir Pirayeh Gar, The Colony, TX (US); Xiaoguang Allan Zhong, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 188 days.

(21) Appl. No.: 17/111,719

(22) Filed: Dec. 4, 2020

(65) Prior Publication Data

US 2022/0178223 A1 Jun. 9, 2022

(51) Int. Cl.
*E21B 33/12* (2006.01)
*E21B 33/129* (2006.01)

(52) U.S. Cl.
CPC ..... *E21B 33/1216* (2013.01); *E21B 33/1292* (2013.01)

(58) Field of Classification Search
CPC ..... E21B 33/1216; E21B 33/1292
See application file for complete search history.

(56) References Cited

U.S. PATENT DOCUMENTS 2,896,724 A * 7/1959 Baker ..... E21B 33/1216 277/338
3,559,733 A * 2/1971 Kilgore ..... E21B 33/1293 166/134
5,197,807 A * 3/1993 Kuznar ..... F01D 25/164 277/645
8,910,722 B2 12/2014 Bishop et al.
10,927,700 B2 * 2/2021 Florindo ..... F01D 17/143
2004/0007366 A1 1/2004 McKee et al.
(Continued)

FOREIGN PATENT DOCUMENTS

CN 104389546 A 3/2015
WO WO 2011/037586 3/2011
WO WO 2017/210189 A1 12/2017

OTHER PUBLICATIONS

Search Report and Written Opinion issued for International Patent Application No. PCT/US2020/063210, dated Aug. 25, 2021, 11 pages.

*Primary Examiner* — D. Andrews
*Assistant Examiner* — Ronald R Runyan
(74) *Attorney, Agent, or Firm* — Conley Rose, P.C.; Rodney B. Carroll

(57) ABSTRACT

A method and apparatus according to which a backup ring is radially expanded to prevent, or at least reduce, extrusion of a sealing element. The backup ring includes an inner ring segment and an outer ring segment. The inner ring segment defines opposing first and second end portions. The outer ring segment defines opposing third and fourth end portions. The third end portion of the outer ring segment telescopically receives, and overlaps, the first end portion of the inner ring segment. Radially expanding the backup ring includes sliding the backup ring up an external tapered surface of a wedge ramp. Sliding the backup ring up the external tapered surface of the wedge ramp telescopes the first end portion of the inner ring segment outwardly from the third end portion of the outer ring segment.

22 Claims, 11 Drawing Sheets

(56) References Cited

U.S. PATENT DOCUMENTS

| | | | | |
|---|---|---|---|---|
| 2010/0038076 | A1* | 2/2010 | Spray | E21B 43/103<br>166/207 |
| 2013/0180705 | A1 | 7/2013 | Fuglestad | |
| 2019/0368304 | A1 | 12/2019 | Deng et al. | |

* cited by examiner

RADIALLY EXPANDABLE ANTI-EXTRUSION BACKUP RING

BACKGROUND

The present application relates generally to anti-extrusion backup rings and, more particularly, to radially expandable anti-extrusion backup rings for use in oil and gas exploration and production operations.

BRIEF DESCRIPTION OF THE DRAWINGS

FIG. 5A-1 is a cross-sectional view of the packer device of FIG. 1 in an unexpanded state or configuration, according to one implementation of the packer device in which the packer device includes the backup ring shown in FIGS. 4A-4C, according to one or more embodiments.

FIG. 5A-2 is a plan view of the backup ring when the packer device of FIG. 1 is in the unexpanded state or configuration, according to one or more embodiments.

FIG. 5B-1 is a cross-sectional view of the packer device of FIG. 1 in an expanded state or configuration, according to the one implementation of the packer device in which the packer device includes the backup ring shown in FIGS. 4A-4C.

FIG. 5B-2 is a plan view of the backup ring when the packer device of FIG. 1 is in the expanded state or configuration, according to one or more embodiments.

DETAILED DESCRIPTION

Figure 1:
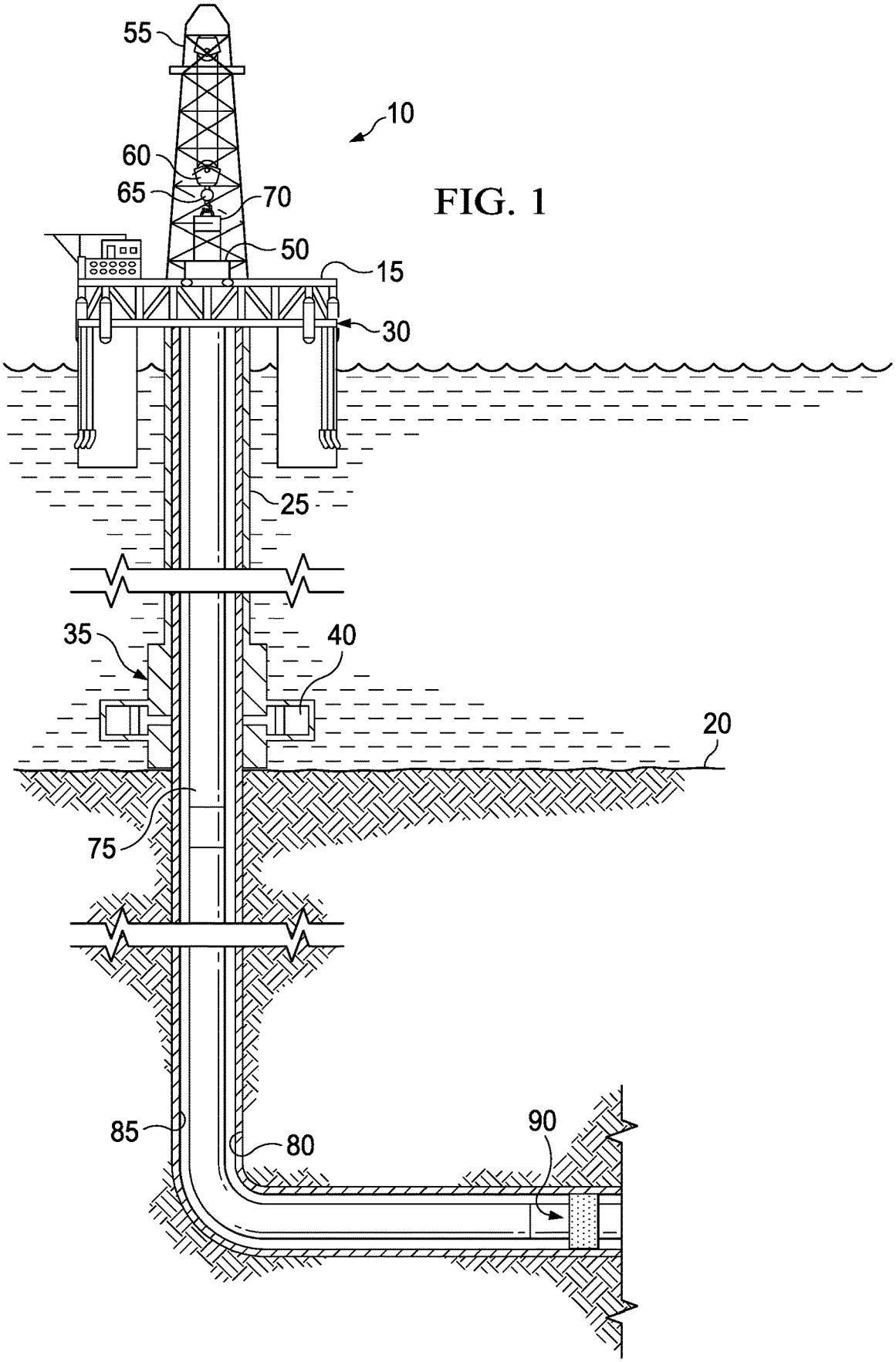
FIG. 1 is a schematic illustration of an offshore oil and gas platform operably coupled to a subsurface packer device, according to one or more embodiments.

The disclosure may repeat reference numerals and/or letters in the various examples or figures. This repetition is for simplicity and clarity and does not in itself dictate a relationship between the various embodiments and/or configurations discussed. Further, spatially relative terms, such as beneath, below, lower, above, upper, uphole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the uphole direction being toward the surface of the wellbore, the downhole direction being toward the toe of the wellbore. Unless otherwise stated, the spatially relative terms are intended to encompass different orientations of the apparatus in use or operation in addition to the orientation depicted in the figures. For example, if an apparatus in the drawings is turned over, elements described as being "below" or "beneath" other elements or features would then be oriented "above" the other elements or features. Thus, the exemplary term "below" can encompass both an orientation of above and below. The apparatus may be otherwise oriented (i.e., rotated 90 degrees) and the spatially relative descriptors used herein may likewise be interpreted accordingly.

Referring to FIG. 1, in an embodiment, an offshore oil and gas rig is schematically illustrated and generally referred to by the reference numeral 10. In an embodiment, the offshore oil and gas rig 10 includes a semi-submersible platform 15 that is positioned over a submerged oil and gas formation 16 located below a sea floor 20. A subsea conduit 25 extends from a deck 30 of the platform 15 to a subsea wellhead installation 35. One or more pressure control devices 40, such as, for example, blowout preventers (BOPs), and/or other equipment associated with drilling or producing a wellbore may be provided at the subsea wellhead installation 35 or elsewhere in the system. The platform 15 may also include a hoisting apparatus 50, a derrick 55, a travel block 60, a hook 65, and a swivel 70, which components are together operable for raising and lowering a conveyance string 75. The conveyance string 75 may be, include, or be part of, for example, a casing, a drill string, a completion string, a work string, a pipe joint, coiled tubing, production tubing, other types of pipe or tubing strings, and/or other types of conveyance strings, such as wireline, slickline, and/or the like. The platform 15 may also include a kelly, a rotary table, a top drive unit, and/or other equipment associated with the rotation and/or translation of the conveyance string 75. A wellbore 80 extends from the subsea wellhead installation 35 and through the various earth strata, including the submerged oil and gas formation 16. In some embodiments, as in FIG. 1, at least a portion of the wellbore 80 includes a casing 85 cemented therein. A packer device 90 is operably coupled to the conveyance string 75, which packer device 90 includes a simple and easy-to-fabricate radially flexible anti-extrusion backup ring deployable under relatively low setting loads to prevent, or at least reduce, extrusion of a sealing element (e.g., a packing element).

Figure 2:
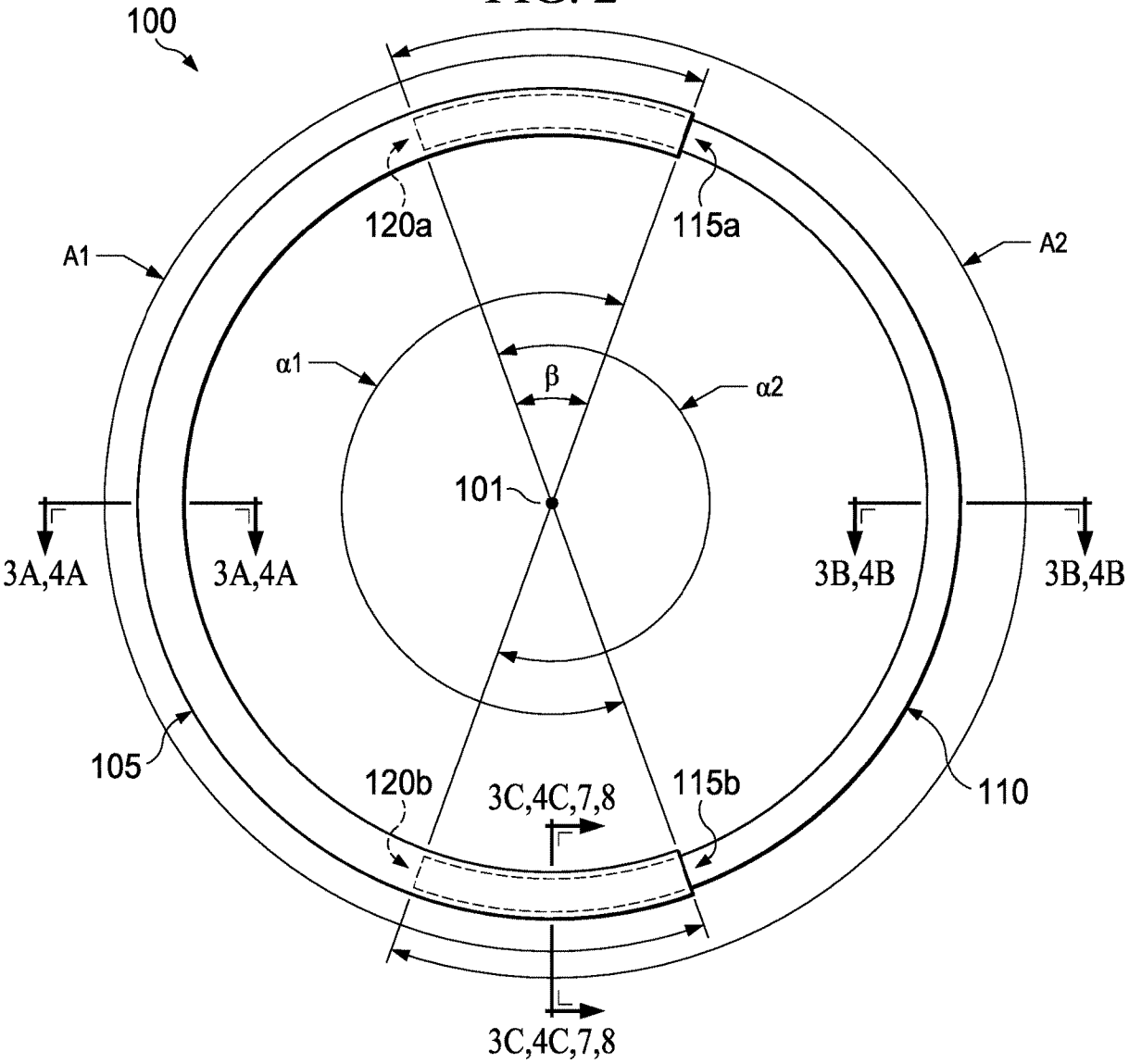
FIG. 2 is a plan view of a radially expandable anti-extrusion backup ring of the packer device of FIG. 1, according to one or more embodiments.

Referring to FIG. 2, in an embodiment, the radially expandable anti-extrusion backup ring of present disclosure is generally referred to by the reference numeral 100. The backup ring 100 extends about a central axis 101 and includes an outer ring segment 105 and an inner ring segment 110. In one or more embodiments, the backup ring 100 is at least partially made of a ductile steel material such as, for example, AISI 1080 (annealed), low carbon steel, 316L, the like, or any combination thereof. The outer ring segment 105 is arc-shaped (e.g., C-shaped), defines opposing end portions 115*a* and 115*b*, and extends along an arc length A1 defined by a central angle α1. In some embodiments, as in FIG. 2, the central angle α1 is greater than 180 degrees. For example, the central angle α1 may be in the range of 210 degrees to 240 degrees.

Likewise, the inner ring segment 110 is arc-shaped (e.g., C-shaped), defines opposing end portions 120*a* and 120*b*, and extends along an arc length A2 defined by a central angle α2. In some embodiments, as in FIG. 2, the central angle α2 is greater the 180 degrees. For example, the central angle α2 may be in the range of 210 degrees to 240 degrees. The end portions 115*a* and 115*b* of the outer ring segment 105 telescopically receive, and overlap, the end portions 120*a* and 120*b*, respectively, of the inner ring segment 110; as a result, the end portions 115*a* and 115*b* of the outer ring segment 105 overlap the end portions 120*a* and 120*b*, respectively, of the inner ring segment 110, by an overlap angle β. For example, the overlap angle β may be in the range of 15 degrees to 60 degrees. The outer ring segment 105 can be temporarily connected to the inner ring segment 110 while the packer device 90 is run downhole (e.g., via tag weld(s), adhesive(s), dissolvable material(s), the like, or any combination thereof); however, this temporary connection is breakable at the target location to allow radial expansion of the backup ring 100.

Although described herein as including the inner ring segment 110 and the outer ring segment 105, the backup ring 100 may instead include multiple (i.e., two or more) inner ring segments interposed between multiple (i.e., two or more) outer ring segments; in some such embodiments, the inner ring segments may each extend along an arc length defined by a central angle of greater than 90 degrees, the outer ring segments may each extend along an arc length defined by a central angle of greater than 90 degrees, or both.

Figure 3A:
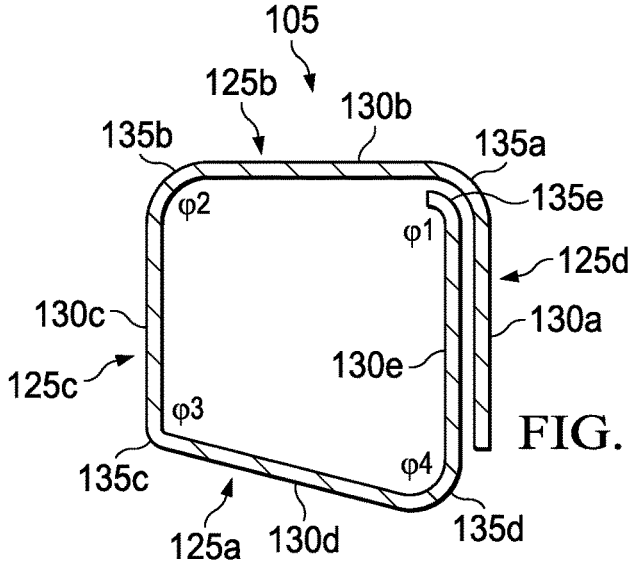
FIG. 3A is a cross-sectional view of one implementation of the backup ring taken along the line 3A-3A of FIG. 2, according to one or more embodiments.

FIG. 3A is a cross-sectional view of the outer ring segment 105 taken along the line 3A-3A of FIG. 2, according to one embodiment of the backup ring 100, which one embodiment may be referred to as a "single layer" embodiment. Referring to FIG. 3A, with continuing reference to FIG. 2, the outer ring segment 105 defines a radially-inward portion 125*a*, a radially-outward portion 125*b*, and opposing end portions 125*c* and 125*d*. More particularly, the outer ring segment 105 includes walls 130*a-e* and bends 135*a-d*.

The wall 130*a* extends at a 90-degree angle relative to the central axis 101 (shown in FIG. 2) of the backup ring 100; as a result, the wall 130*a* is disk-shaped. The wall 130*a* is part of the end portion 125*d*. The bend 135*a* is formed between the wall 130*a* and the wall 130*b*, causing the walls 130*a* and 130*b* to extend at a bend angle φ1 relative to each other. The bend angle φ1 is 90 degrees; as a result, the wall 130*b* is cylindrical. The wall 130*b* is part of the radially-outward portion 125*b*. The bend 135*b* is formed between the wall 130*b* and the wall 130*c*, causing the walls 130*b* and 130*c* to extend at a bend angle φ2 relative to each other. The bend angle φ2 is 90 degrees; as a result, the wall 130*c* is disk-shaped. The wall 130*c* is part of the end portion 125*c*. The bend 135*c* is formed between the wall 130*c* and the wall 130*d*, causing the walls 130*c* and 130*d* to extend at a bend angle φ3 relative to each other. The bend angle φ3 is greater than 90 degrees by an amount; as a result, the wall 130*d* is tapered (e.g., frustoconical) having a reduced diameter adjacent the end portion 125*c* and an enlarged diameter adjacent the end portion 125*d*. The wall 130*d* is part of the radially-inward portion 125*a*. The bend 135*d* is formed between the wall 130*d* and the wall 130*e*, causing the walls 130*d* and 130*e* to extend at a bend angle φ4 relative to each other. The bend angle φ4 is less than 90 degrees by an amount equal to the amount by which the bend angle φ3 is greater than 90 degrees; as a result, the wall 130*e* is disk-shaped. The wall 130*e* is part of the end portion 125*d*. Moreover, the wall 130*e* extends inside the wall 130*a*, that is, the wall 130*a* overlaps the wall 130*e*, to form the end portion 125*d* of the outer ring segment 105.

Alternatively, the walls 130*a* and 130*e* may be omitted and replaced by a single integrated wall at the end portion 125*d* of the outer ring segment 105 so that the outer ring segment 105 has a closed tubular cross section (like a pipe).

In some embodiments, as in FIG. 3A, a bend 135*e* is formed in the outer ring segment 105 at an end of the wall 130*e* opposite the bend 135*d*; in such embodiments, the bend 135*e* extends inside the bend 135*a*.

Figure 3B:
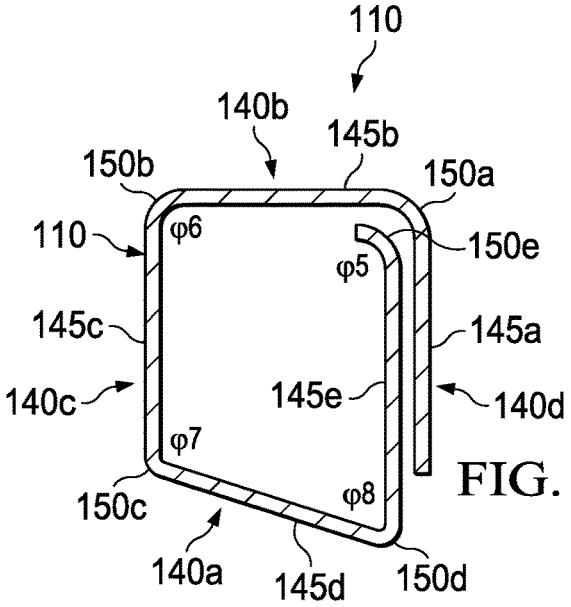
FIG. 3B is a cross-sectional view of the one implementation of the backup ring taken along the line 3B-3B of FIG. 2, according to one or more embodiments.

FIG. 3B is a cross-sectional view of the inner ring segment 110 taken along the line 3B-3B of FIG. 2, according to the one embodiment of the backup ring 100. Referring to FIG. 3B, with continuing reference to FIG. 2, the inner ring segment 110 defines a radially-inward portion 140*a*, a radially-outward portion 140*b*, and opposing end portions 140*c* and 140*d*. More particularly, the inner ring segment 110 includes walls 145*a-e* and bends 150*a-d*.

The wall 145*a* extends at a 90-degree angle relative to the central axis 101 (shown in FIG. 2) of the backup ring 100; as a result, the wall 145*a* is disk-shaped. The wall 145*a* is part of the end portion 140*d*. The bend 150*a* is formed between the wall 145*a* and the wall 145*b*, causing the walls 145*a* and 145*b* to extend at a bend angle φ5 relative to each other. The bend angle φ5 is 90 degrees; as a result, the wall 145*b* is cylindrical. The wall 145*b* is part of the radially-outward portion 140*b*. The bend 150*b* is formed between the wall 145*b* and the wall 145*c*, causing the walls 145*b* and 145*c* to extend at a bend angle φ6 relative to each other. The bend angle φ6 is 90 degrees; as a result, the wall 145*c* is disk-shaped. The wall 145*c* is part of the end portion 140*c*. The bend 150*c* is formed between the wall 145*c* and the wall 145*d*, causing the walls 145*c* and 145*d* to extend at a bend angle φ7 relative to each other. The bend angle φ7 is greater than 90 degrees by an amount; as a result, the wall 145*d* is tapered (e.g., frustoconical) having a reduced diameter adjacent the end portion 140*c* and an enlarged diameter adjacent the end portion 140*d*. The wall 145*d* is part of the radially-inward portion 140*a*. The bend 150*d* is formed between the wall 145*d* and the wall 145*e*, causing the walls 145*d* and 145*e* to extend at a bend angle φ8 relative to each other. The bend angle φ8 is less than 90 degrees by an amount equal to the amount by which the bend angle φ7 is greater than 90 degrees; as a result, the wall 145*e* is disk-shaped. The wall 145*e* is part of the end portion 140*d*. Moreover, the wall 145*e* extends inside the wall 145*a*, that is, the wall 145*a* overlaps the wall 145*e*, to form the end portion 140*d* of the inner ring segment 110.

Alternatively, the walls 145*a* and 145*e* may be omitted and replaced by a single integrated wall at the end portion 140*d* of the inner ring segment 110 so that the inner ring segment 110 has a closed tubular cross section (like a pipe).

In some embodiments, as in FIG. 3B, a bend 150*e* is formed in the inner ring segment 110 at an end of the wall 145*e* opposite the bend 150*d*; in such embodiments, the bend 150*e* extends inside the bend 150*a*.

Figure 3C:
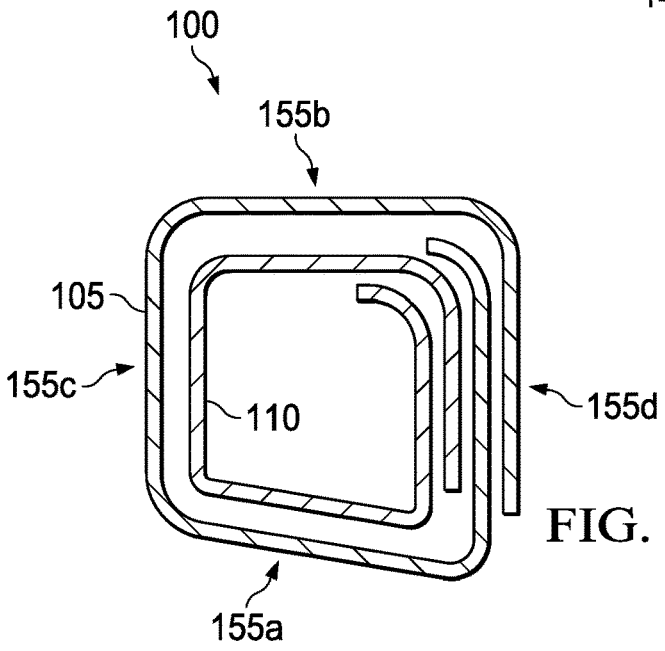
FIG. 3C is a cross-sectional view of the one implementation of the backup ring taken along the line 3C-3C of FIG. 2, according to one or more embodiments.

FIG. 3C is a cross-sectional view of the backup ring 100 taken along the line 3C-3C of FIG. 2, according to the one embodiment of the backup ring 100. Referring to FIG. 3C, with continuing reference to FIGS. 2, 3A, and 3B, the end portion 120*b* of the inner ring segment 110 is received by the end portion 115*b* of the outer ring segment 105 so that, at the end portions 115*b* and 120*b*: the radially-inward portion 140*a* of the inner ring segment 110 extends adjacent, and interior to, the radially-inward portion 125*a* of the outer ring segment 105; the radially-outward portion 140*b* of the inner ring segment 110 extends adjacent, and interior to, the radially-outward portion 125*b* of the outer ring segment 105; the end portion 140*c* of the inner ring segment 110 extends adjacent, and interior to, the end portion 125*c* of the outer ring segment 105; and the end portion 140*d* of the inner ring segment 110 extends adjacent, and interior to, the end portion 125*d* of the outer ring segment 105.

In addition, or instead, although not shown in FIG. 3C, the wall 145*a* of the inner ring segment 110 may extend between the walls 130*a* and 130*e* of the outer ring segment 105, and the wall 130*e* of the outer ring segment 105 may extend between the walls 145*a* and 145*e* of the inner ring segment 110. In other words: the wall 145*d* of the inner ring segment 110 and the wall 130*d* of the outer ring segment 105 together form a radially-inward portion 155*a* of the backup ring 100; the wall 145*b* of the inner ring segment 110 and the wall 130*b* of the outer ring segment 105 together form a radially-outward portion 155*b* of the backup ring 100; the wall 145*c* of the inner ring segment 110 and the wall 130*c* of the outer ring segment 105 together form an end portion 155*c* of the backup ring 100; and the walls 145*a* and 145*e* of the inner ring segment 110 and the walls 130*a* and 130*e* of the outer ring segment 105 together form an end portion 155*d* of the backup ring 100. In one or more embodiments, the manner in which the end portion 115*a* of the outer ring segment 105 receives the end portion 120*a* of the inner ring segment 110 is substantially identical to the manner in which the end portion 115*b* of the outer ring segment 105 receives the end portion 120*b* of the inner ring segment 110, as described above in connection with FIG. 3C.

Although one specific embodiment of the backup ring 100 has been shown and described above in connection with FIGS. 3A-3C, other embodiments of the backup ring 100 are contemplated, including embodiments in which the outer ring segment 105 is omitted and replaced by another outer ring segment having a hollow cross section, and the inner ring segment 110 is omitted and replaced by another inner ring segment.

Figure 4A:
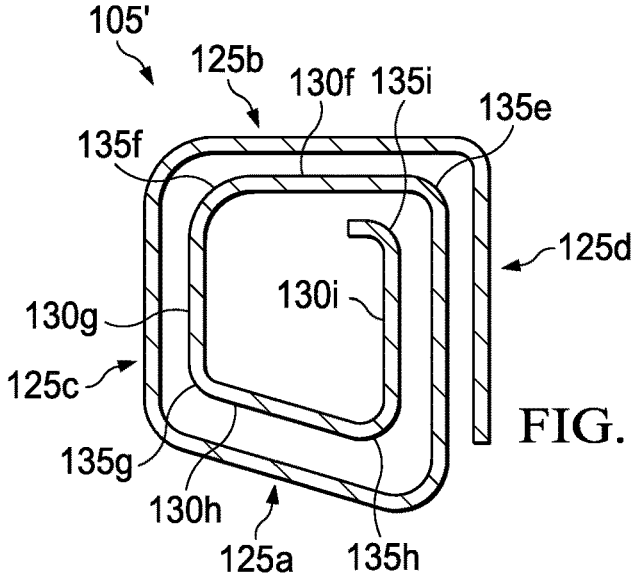
FIG. 4A is a cross-sectional view of another implementation of the backup ring taken along the line 4A-4A of FIG. 2, according to one or more embodiments.

FIG. 4A is a cross-sectional view taken along the line 4A-4A of FIG. 2, according to another embodiment of the backup ring 100 in which the outer ring segment 105 is omitted and replaced with an outer ring segment 105' and the inner ring segment 110 is omitted and replace with an inner ring segment 110', which another embodiment may be referred to herein as a "multi-layer" embodiment. Referring to FIG. 4A, with continuing reference to FIG. 2, the outer ring segment 105' defines the radially-inward portion 125*a*, the radially-outward portion 125*b*, and the opposing end portions 125*c* and 125*d*. More particularly, the outer ring segment 105' includes features substantially identical to corresponding features of the outer ring segment 105, including the walls 130*a-e* and the bends 135*a-e*; accordingly, the reference numerals for the walls 130*a-e* and the bends 135*a-d* are not indicated in FIG. 4A.

In addition to the walls 130*a-e* and the bends 135*a-e*, the outer ring segment 105' includes walls 130*f-i* and bends 135*f-h*. The bend 135*e* is formed between the wall 130*e* and the wall 130*f*, causing the walls 130*e* and 130*f* to extend at the bend angle φ1 relative to each other. As discussed above, the bend angle φ1 (shown in FIG. 3A) is 90 degrees; as a result, the wall 130*f* is cylindrical. The wall 130*f* is part of the radially-outward portion 125*b*. Moreover, the wall 130*f* extends inside the wall 130*b*, that is, the wall 130*b* overlaps the wall 130*f*, to form the radially-outward portion 125*b* of the outer ring segment 105'. The bend 135*f* is formed between the wall 130*f* and the wall 130*g*, causing the walls 130*f* and 130*g* to extend at the bend angle φ2 relative to each other. As discussed above, the bend angle φ2 (shown in FIG. 3A) is 90 degrees; as a result, the wall 130*g* is disk-shaped. The wall 130*g* is part of the end portion 125*c*. Moreover, the wall 130*g* extends inside the wall 130*c*, that is, the wall 130*c* overlaps the wall 130*g*, to form the end portion 125*c* of the outer ring segment 105'. The bend 135*g* is formed between the wall 130*g* and the wall 130*h*, causing the walls 130*g* and 130*h* to extend at the bend angle φ3 relative to each other. As discussed above, the bend angle φ3 (shown in FIG. 3A) is greater than 90 degrees by an amount; as a result, the wall 130*h* is tapered (e.g., frustoconical) having a reduced diameter adjacent the end portion 125*c* and an enlarged diameter adjacent the end portion 125*d*. The wall 130*h* is part of the radially-inward portion 125*a*. Moreover, the wall 130*h* extends inside the wall 130*d*, that is, the wall 130*d* overlaps the wall 130*h*, to form the radially-inward portion 125*a* of the outer ring segment 105'. The bend 135*h* is formed between the wall 130*h* and the wall 130*i*, causing the walls 130*h* and 130*i* to extend at the bend angle φ4 relative to each other. As discussed above, the bend angle φ4 (shown in FIG. 3A) is less than 90 degrees by an amount equal to the amount by which the bend angle φ3 is greater than 90 degrees; as a result, the wall 130*i* is disk-shaped. The wall 130*i* is part of the end portion 125*d*. Moreover, the wall 130*i* extends inside the walls 130*a* and 130*e*, that is, the walls 130*a* and 130*e* overlap the wall 130*i*, to form the end portion 125*d* of the outer ring segment 105'. In some embodiments, as in FIG. 4A, a bend 135*i* is formed in the outer ring segment 105' at an end of the wall 130*i* opposite the bend 135*h*; in such embodiments, the bend 135*i* extends inside both the bend 135*a* and the bend 135*e*.

Figure 4B:
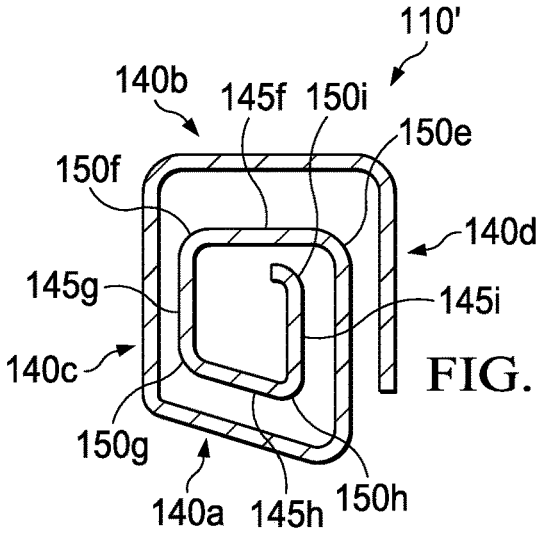
FIG. 4B is a cross-sectional view of the another implementation of the backup ring taken along the line 4B-4B of FIG. 2, according to one or more embodiments.

FIG. 4B is a cross-sectional view taken along the line 4B-4B of FIG. 2, according to the another embodiment of the backup ring 100 in which: the outer ring segment 105 is omitted and replaced with the outer ring segment 105'; and the inner ring segment 110 is omitted and replaced with the inner ring segment 110'. Referring to FIG. 4B, with continuing reference to FIG. 2, the inner ring segment 110' defines the radially-inward portion 140*a*, the radially-outward portion 140*b*, and the opposing end portions 140*c* and 140*d*. More particularly, the inner ring segment 110' includes features substantially identical to corresponding features of the inner ring segment 110, including the walls 145*a-e* and the bends 150*a-e*; accordingly, the reference numerals for the walls 145*a-e* and the bends 150*a-d* are not indicated in FIG. 4B.

In addition to the walls 145*a-e* and the bends 150*a-e*, the inner ring segment 110' includes walls 145*f-i* and bends 150*f-h*. The bend 150*e* is formed between the wall 145*e* and the wall 145*f*, causing the walls 145*e* and 145*f* to extend at the bend angle φ5 relative to each other. As discussed above, the bend angle φ5 (shown in FIG. 3B) is 90 degrees; as a result, the wall 145*f* is cylindrical. The wall 145*f* is part of the radially-outward portion 140*b*. Moreover, the wall 145*f* extends inside the wall 145*b*, that is, the wall 145*b* overlaps the wall 145*f*, to form the radially-outward portion 140*b* of the inner ring segment 110'. The bend 150*f* is formed between the wall 145*f* and the wall 145*g*, causing the walls 145*f* and 145*g* to extend at the bend angle φ6 relative to each other. As discussed above, the bend angle φ6 (shown in FIG. 3B) is 90 degrees; as a result, the wall 145*g* is disk-shaped. The wall 145*g* is part of the end portion 140*c*. Moreover, the wall 145*g* extends inside the wall 145*c*, that is, the wall 145*c* overlaps the wall 145*g*, to form the end portion 140*c* of the inner ring segment 110'. The bend 150*g* is formed between the wall 145*g* and the wall 145*h*, causing the walls 145*g* and 145*h* to extend at the bend angle φ7 relative to each other. As discussed above, the bend angle φ7 (shown in FIG. 3B) is greater than 90 degrees by an amount; as a result, the wall 145*h* is tapered (e.g., frustoconical) having a reduced diameter adjacent the end portion 140*c* and an enlarged diameter adjacent the end portion 140*d*.

The wall 145*h* is part of the radially-inward portion 140*a*. Moreover, the wall 145*h* extends inside the wall 145*d*, that is, the wall 145*d* overlaps the wall 145*h*, to form the radially-inward portion 140*a* of the inner ring segment 110'. The bend 150*h* is formed between the wall 145*h* and the wall 145*i*, causing the walls 145*h* and 145*i* to extend at the bend angle φ8 relative to each other. As discussed above, the bend angle φ8 (shown in FIG. 3B) is less than 90 degrees by an amount equal to the amount by which the bend angle φ7 is greater than 90 degrees; as a result, the wall 145*i* is disk-shaped. The wall 145*i* is part of the end portion 140*d*. Moreover, the wall 145*i* extends inside the walls 145*a* and 145*e*, that is, the walls 145*a* and 145*e* overlap the wall 145*i*, to form the end portion 140*d* of the inner ring segment 110'. In some embodiments, as in FIG. 4B, a bend 150*i* is formed in the inner ring segment 110' at an end of the wall 145*i* opposite the bend 150*h*; in such embodiments, the bend 150*i* extends inside both the bend 150*a* and the bend 150*e*.

Figure 4C:
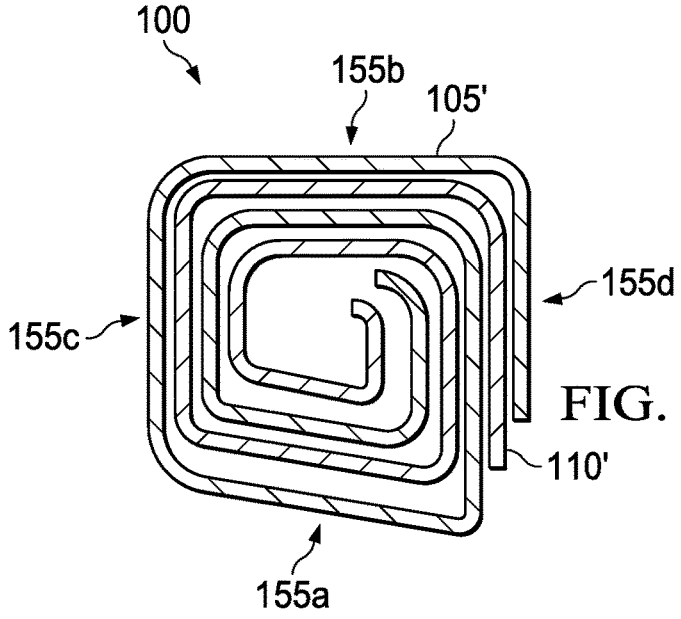
FIG. 4C is a cross-sectional view of the another implementation of the backup ring taken along the line 4C-4C of FIG. 2, according to one or more embodiments.

FIG. 4C is a cross-sectional view taken along the line 4C-4C of FIG. 2, according to the another embodiment of the backup ring 100 in which: the outer ring segment 105 is omitted and replaced with the outer ring segment 105'; and the inner ring segment 110 is omitted and replaced with the inner ring segment 110'. Referring to FIG. 4C, with continuing reference to FIGS. 2, 4A, and 4B, the end portion 120*b* of the inner ring segment 110' is received by the end portion 115*b* of the outer ring segment 105' so that, at the end portions 115*b* and 120*b*: the wall 145*a* of the inner ring segment 110' extends between the walls 130*a* and 130*e* of the outer ring segment 105'; the wall 145*b* of the inner ring segment 110' extends between the walls 130*b* and 130*f* of the outer ring segment 105'; the wall 145*c* of the inner ring segment 110' extends between the walls 130*c* and 130*g* of the outer ring segment 105'; the wall 145*d* of the inner ring segment 110' extends between the walls 130*d* and 130*h* of the outer ring segment 105'; the wall 145*e* of the inner ring segment 110' extends between the walls 130*e* and 130*i* of the outer ring segment 105'; the wall 145*f* of the inner ring segment 110' extends adjacent, and interior to, the wall 130*f* of the outer ring segment 105'; the wall 145*g* of the inner ring segment 110' extends adjacent, and interior to, the wall 130*g* of the outer ring segment 105'; the wall 145*h* of the inner ring segment 110' extends adjacent, and interior to, the wall 130*h* of the outer ring segment 105'; and the wall 145*i* of the inner ring segment 110' extends adjacent, and interior to, the wall 130*i* of the outer ring segment 105'.

In other words: the walls 145*d* and 145*h* of the inner ring segment 110' are interposed with the walls 130*d* and 130*h* of the outer ring segment 105' to form the radially-inward portion 155*a* of the backup ring 100; the walls 145*b* and 145*f* of the inner ring segment 110' are interposed with the walls 130*b* and 130*f* of the outer ring segment 105' to form the radially-outward portion 155*b* of the backup ring 100; the walls 145*c* and 145*g* of the inner ring segment 110' are interposed with the walls 130*c* and 130*g* of the outer ring segment 105' to form the end portion 155*c* of the backup ring 100; and the walls 145*a* and 145*e* of the inner ring segment 110' are interposed with the walls 130*a*, 130*e*, and 130*i* of the outer ring segment 105' to form the end portion 155*d* of the backup ring 100. In one or more embodiments, the manner in which the end portion 115*a* of the outer ring segment 105' receives the end portion 120*a* of the inner ring segment 110' is substantially identical to the manner in which the end portion 115*b* of the outer ring segment 105' receives the end portion 120*b* of the inner ring segment 110', as described above in connection with FIG. 4C.

Although one specific embodiment of the backup ring 100 has been shown and described above in connection with FIGS. 4A-4C, other embodiments of the backup ring 100 are contemplated, including embodiments in which the outer ring segment 105' is omitted and replaced by another outer ring segment having a hollow cross section, and the inner ring segment 110' is omitted and replaced by another inner ring segment.

Figures 1, 5A:
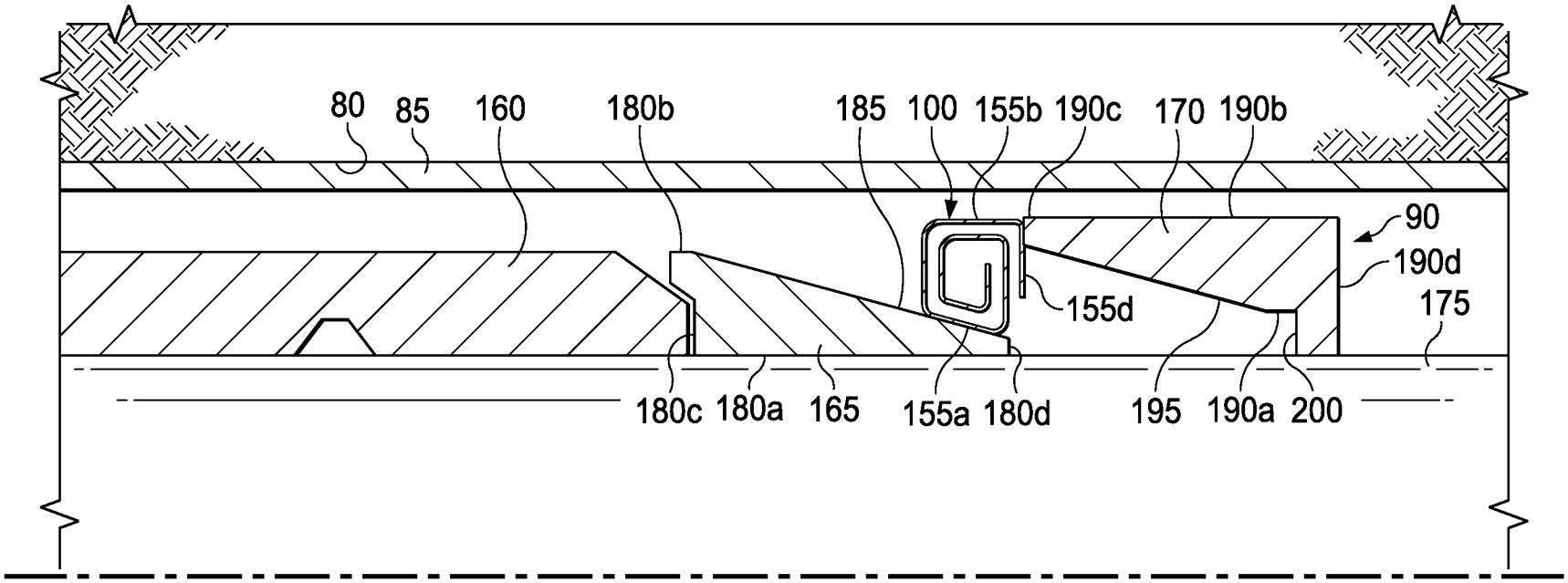
Figures 2, 5A:
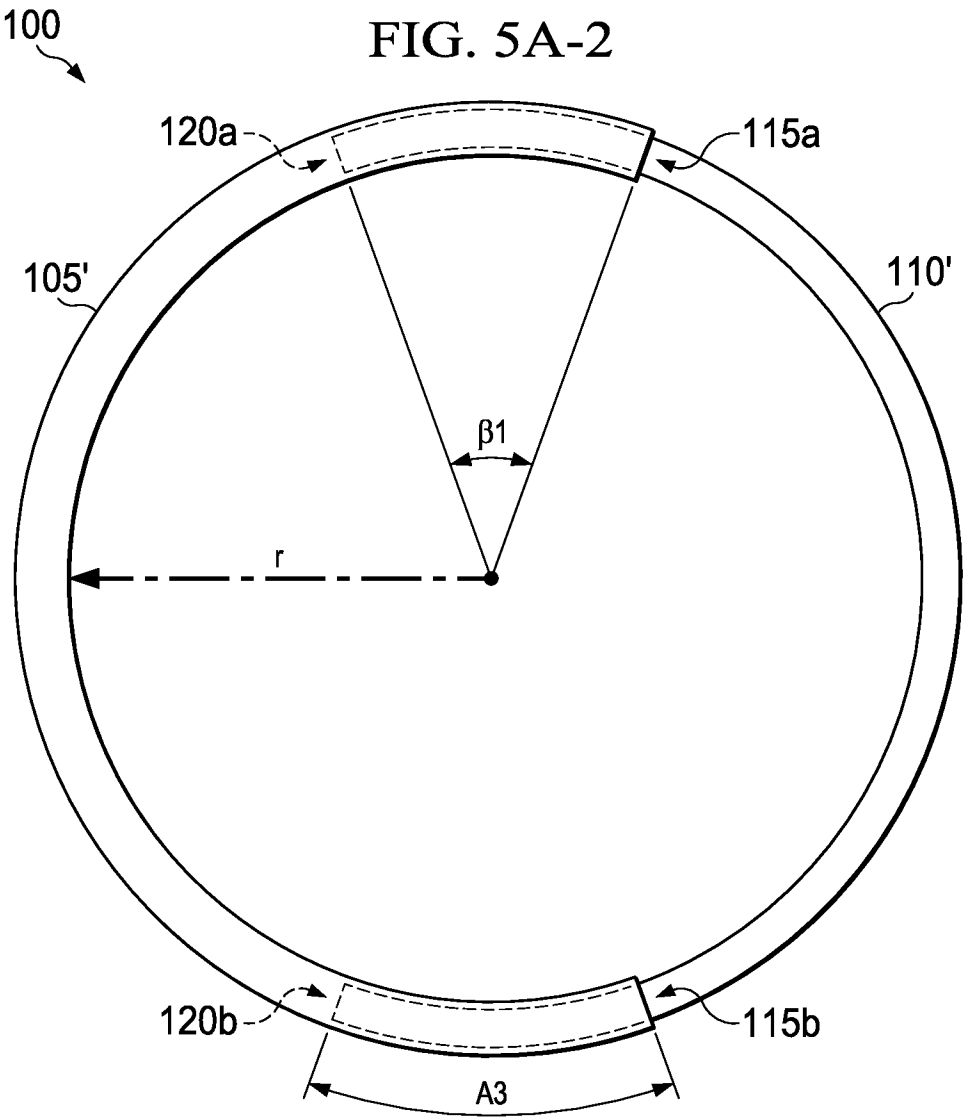

Referring to FIG. 5A-1, with continuing reference to FIG. 1, in an embodiment, the packer device 90 includes a packing element 160 (also referred to herein as a "sealing element"), a wedge ramp 165, the another embodiment of the backup ring 100 (shown in FIGS. 4A-4C, i.e., including the outer ring segment 105' and the inner ring segment 110'), and a piston 170, all positioned around a mandrel 175. Although shown in FIG. 5A-1 as including the another embodiment of the backup ring 100, the packer device 90 may instead include the one embodiment of the backup ring 100 (shown in FIGS. 3A-3C, i.e., including the outer ring segment 105 and the inner ring segment 110). The wedge ramp 165 is adapted to impose radially-outward force on the backup ring 100, and includes a radially-inward portion 180*a*, a radially-outward portion 180*b*, and opposing end portions 180*c* and 180*d*. The radially-inward portion 180*a* of the wedge ramp 165 extends about, and is slidable along, the mandrel 175. The end portion 180*c* of the wedge ramp 165 is adapted to engage the packing element 160. The radially-outward portion 180*b* of the wedge ramp 165 defines an external tapered (e.g., frustoconical) surface 185 having an enlarged diameter toward the end portion 180*c* and a reduced diameter toward the end portion 180*d*.

The radially-inward portion 155*a* of the backup ring 100 extends about, and is slidable along, the external tapered surface 185 at the radially-outward portion 180*b* of the wedge ramp 165. The piston 170 includes a radially-inward portion 190*a*, a radially-outward portion 190*b*, and opposing end portions 190*c* and 190*d*. The end portion 190*c* of the piston 170 is adapted to engage the end portion 155*d* of the backup ring 100. In addition, or instead, the piston 170 may be adapted to engage the radially-outward portion 155*b* of the backup ring 100 to thereby trap the backup ring 100 between the piston 170 and the wedge ramp 165. The radially-inward portion 190*a* of the piston 170 defines an internal tapered (e.g., frustoconical) surface 195 having an enlarged diameter toward the end portion 190*c* and a reduced diameter toward the end portion 190*d*. The internal tapered surface 195 of the piston 170 is adapted to engage (e.g., matingly) the external tapered surface 185 of the wedge ramp 165, as will be described in further detail below. The piston 170 further includes an internal stop collar 200 at the end portion 190*d*, adjacent the reduced diameter of the internal tapered surface 195. The internal stop collar 200 extends about, and is slidable along, the mandrel 175.

Moreover, the internal stop collar 200 has an internal diameter that is smaller than the reduced diameter of the internal tapered surface 195.

Referring to FIGS. 5A-1 and 5A-2, with continuing reference to FIG. 1, in operation, the packer device 90 is run downhole into the wellbore 80 in an unexpanded state or configuration, in which: the packing element 160 is retained on the mandrel 175 in an un-expanded state or configuration (shown in FIG. 5A-1); the backup ring 100 has a radius r (shown in FIG. 5A-2); and the end portions 115*a* and 115*b* of the outer ring segment 105' telescopically receive and overlap the end portions 120*a* and 120*b*, respectively, of the inner ring segment 110' by an overlap angle β1, resulting in an overlap arc length A3 (shown in FIG. 5A-2).

Figures 1, 5B:
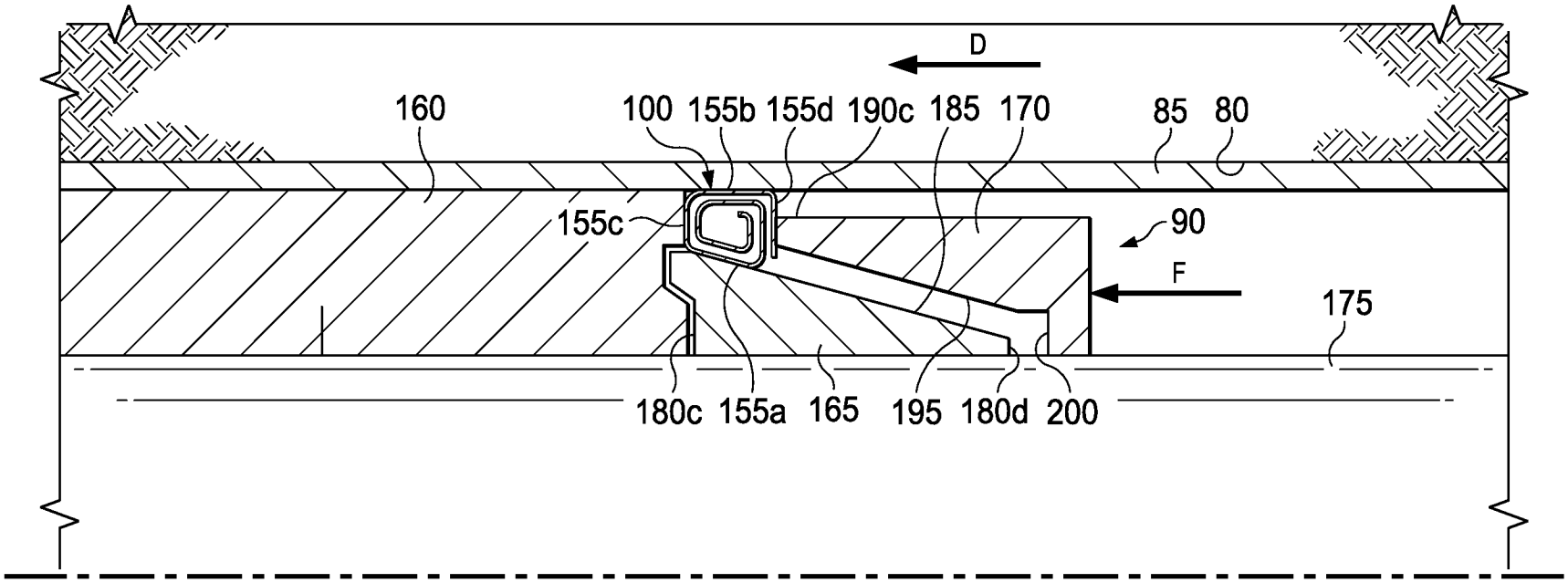
Figures 2, 5B:
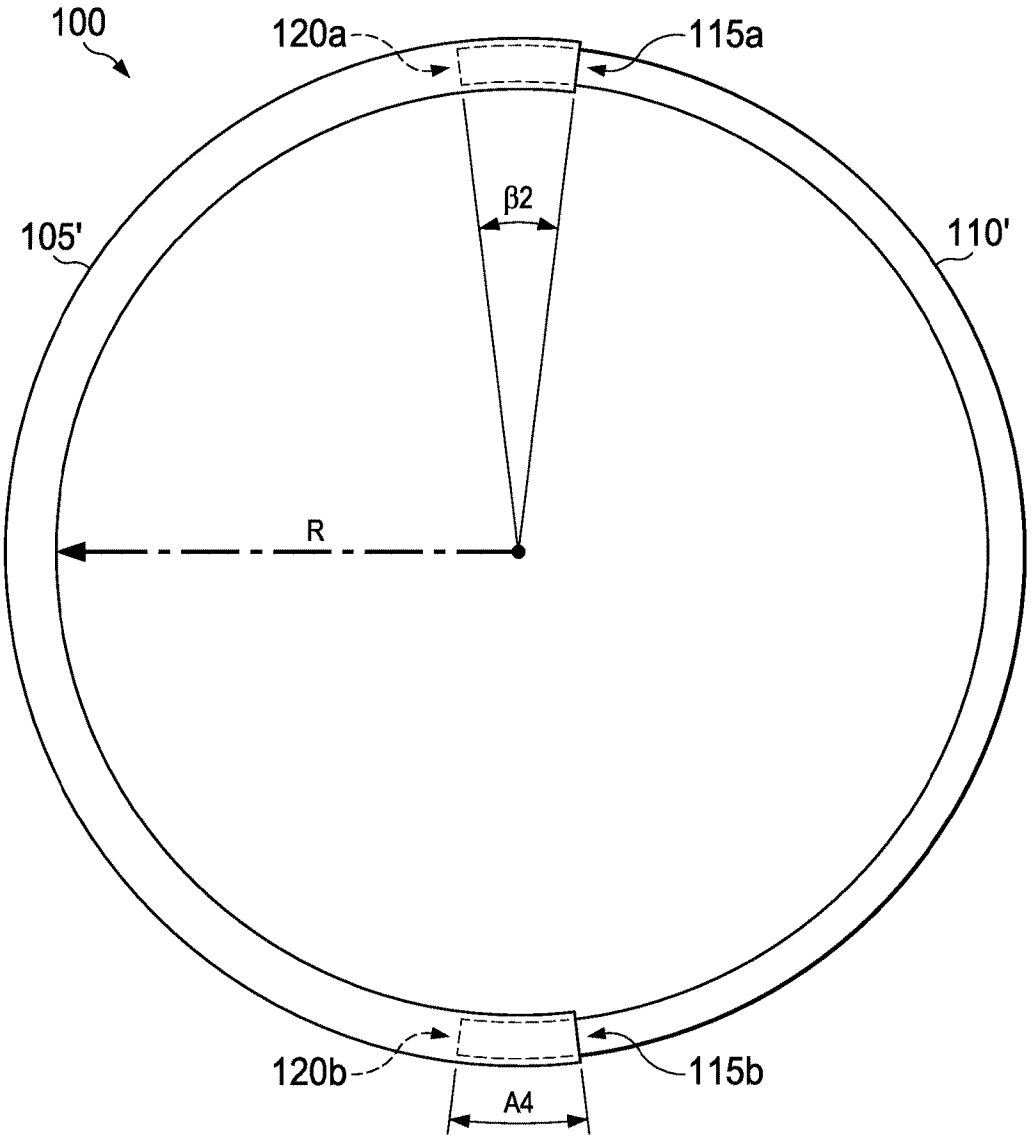

Referring additionally to FIGS. 5B-1 and 5B-2, with continuing reference to FIGS. 5A-1 and 5A-2, in operation, after reaching its target depth, the packer device 90 is actuated from the unexpanded state or configuration to an expanded state or configuration, in which: the packing element 160 is expanded to engage the casing 85 (shown in FIG. 5B-1; or, alternatively, the packing element 160 may be expanded to engage an open-hole portion of the wellbore 80); the backup ring 100 has a radius R (shown in FIG. 5B-2), which radius R is larger than the radius r of the backup ring 100 when the packing device 90 is in the unexpanded configuration (shown in FIG. 5A-2); and the end portions 115*a* and 115*b* of the outer ring segment 105' telescopically receive and overlap the end portions 120*a* and 120*b*, respectively, of the inner ring segment 110' by an overlap angle β2 (shown in FIG. 5B-2), resulting in an overlap arc length A4 (the overlap angle β2 is smaller than the overlap angle β1 of the backup ring 100 when the packing device 90 is in the unexpanded configuration, and thus the overlap arc length A4 is also smaller than the overlap arc length A3).

As shown in FIG. 5B-1, to actuate the packer device 90 from the unexpanded state or configuration shown in FIGS. 5A-1 and 5A-2 to the expanded state or configuration shown in FIGS. 5B-1 and 5B-2, a setting force F is applied to the piston 170 to move the piston 170 in a direction D (i.e., towards the packing element 160) and relative to the mandrel 175. Although shown in FIG. 5B-1 as being applied to the piston 170 to move the piston 170 in the direction D, the setting force F may instead be applied to the packing device 90 in a different manner.

The end portion 190*c* of the piston 170 engages the end portion 155*d* of the backup ring 100, moving the backup ring 100 in the direction D and relative to the wedge ramp 165. In addition, or instead, the piston 170 may engage the radially-outward portion 155*b* of the backup ring 100 to thereby trap the backup ring 100 between the piston 170 and the wedge ramp 165. As the backup ring 100 moves in the direction D and relative to the wedge ramp 165, the backup ring 100 expands radially, that is, the radially-inward portion 155*a* of the backup ring 100 slides up the external tapered surface 185 of the wedge ramp 165, causing the end portions 120*a* and 120*b* of the inner ring segment 110' to telescope outwardly from the end portions 115*a* and 115*b*, respectively, of the outer ring segment 105', as shown in FIG. 5B-2, until the backup ring 100 reaches the end portion 180*c* of the wedge ramp 165 and the radially-outward portion 155*b* of the backup ring 100 engages the casing 85 (shown in FIG. 5B-1; or, alternatively, until the radially-outward portion 155*b* of the backup ring 100 contacts an open-hole portion of the wellbore 80). Alternatively, the piston 170 may engage the radially-outward portion 155*b* of the backup ring 100 to thereby trap the backup ring 100 between the piston 170 and the wedge ramp 165. During radial expansion, the backup ring 100 also experiences cross-sectional deformation (e.g., plastic deformation), allowing the backup ring 100 to be forced tight in place between the interior of the casing 85 (or the open-hole portion of the wellbore 80) and the wedge ramp 165, filling the extrusion gap.

The piston 170 engages the wedge ramp 165, that is, the internal tapered surface 195, the internal stop collar 200, or both, of the piston 170 engage the external tapered surface 185, the end portion 180*d*, or both, respectively, of the wedge ramp 165, moving the wedge ramp 165 in the direction D and relative to the mandrel 175. The end portion 180*c* of the wedge ramp 165 and the end portion 155*c* of the backup ring 100 engage the packing element 160, axially compressing and radially expanding the packing element 160 into engagement with the casing 85 (shown in FIG. 5B-1; or, alternatively, the packing element 160 may be expanded to engage an open-hole portion of the wellbore 80). During the radial expansion of the packing element 160, the radially-expanded backup ring 100 positioned at the end portion 180*c* of the wedge ramp 165 prevents, or at least reduces, extrusion of the packing element 160 by filling the extrusion gap between the wedge ramp 165 and the casing 85 (or the open-hole portion of the wellbore 80).

Figure 6A:
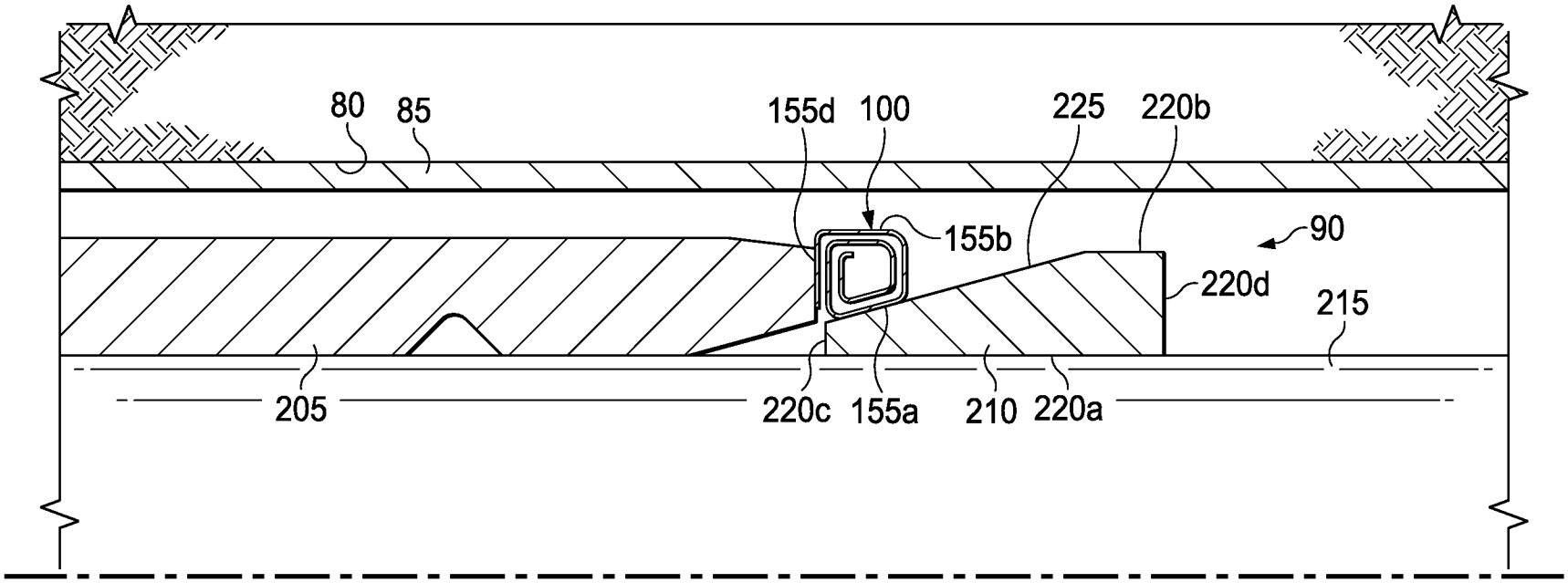
FIG. 6A is a cross-sectional view of the packer device of FIG. 1 in an unexpanded state or configuration, according to another implementation of the packer device in which the packer device includes the backup ring shown in FIGS. 4A-4C, according to one or more embodiments.

Referring to FIG. 6A, with continuing reference to FIG. 1, in another embodiment, the packer device 90 includes a packing element 205 (also referred to herein as a "sealing element"), a wedge ramp 210, and the another embodiment of the backup ring 100 (shown in FIGS. 4A-4C, i.e., including the outer ring segment 105' and the inner ring segment 110'), all positioned around a mandrel 215. Although shown in FIG. 6A as including the another embodiment of the backup ring 100, the packer device 90 may instead include the one embodiment of the backup ring 100 (shown in FIGS. 3A-3C, i.e., including the outer ring segment 105 and the inner ring segment 110). The wedge ramp 210 is adapted to impose radially-outward force on the backup ring 100, and includes a radially-inward portion 220*a*, a radially-outward portion 220*b*, and opposing end portions 220*c* and 220*d*. The radially-inward 220*a* portion of the wedge ramp 210 extends about, and is slidable along, the mandrel 215. The end portion 220*c* of the wedge ramp 210 is adapted to engage the packing element 205. Likewise, the end portion 155*d* of the backup ring 100 is adapted to engage the packing element 205. The radially-outward portion 220*b* of the wedge ramp 210 defines an external tapered (e.g., frustoconical) surface 225 having a reduced diameter toward the end portion 220*c* and an enlarged diameter toward the end portion 220*d*. The radially-inward portion 155*a* of the backup ring 100 extends about, and is slidable along, the external tapered surface 225 at the radially-outward portion 220*b* of the wedge ramp 210. In one or more embodiments, the backup ring 100 is placed in the vicinity of the packing element 205 but is not mechanically connected thereto.

Referring to FIGS. 6A and 5A-2, with continuing reference to FIG. 1, in operation, the packer device 90 is run downhole into the wellbore 80 in an unexpanded state or configuration, in which: the packing element 205 is retained on the mandrel 215 in an un-expanded state or configuration (shown in FIG. 6A); the backup ring 100 has a radius r (shown in FIG. 5A-2); and the end portions 115*a* and 115*b* of the outer ring segment 105' telescopically receive and overlap the end portions 120*a* and 120*b*, respectively, of the inner ring segment 110' by an overlap angle β1, resulting in an overlap arc length A3 (shown in FIG. 5A-2;).

Figure 6B:
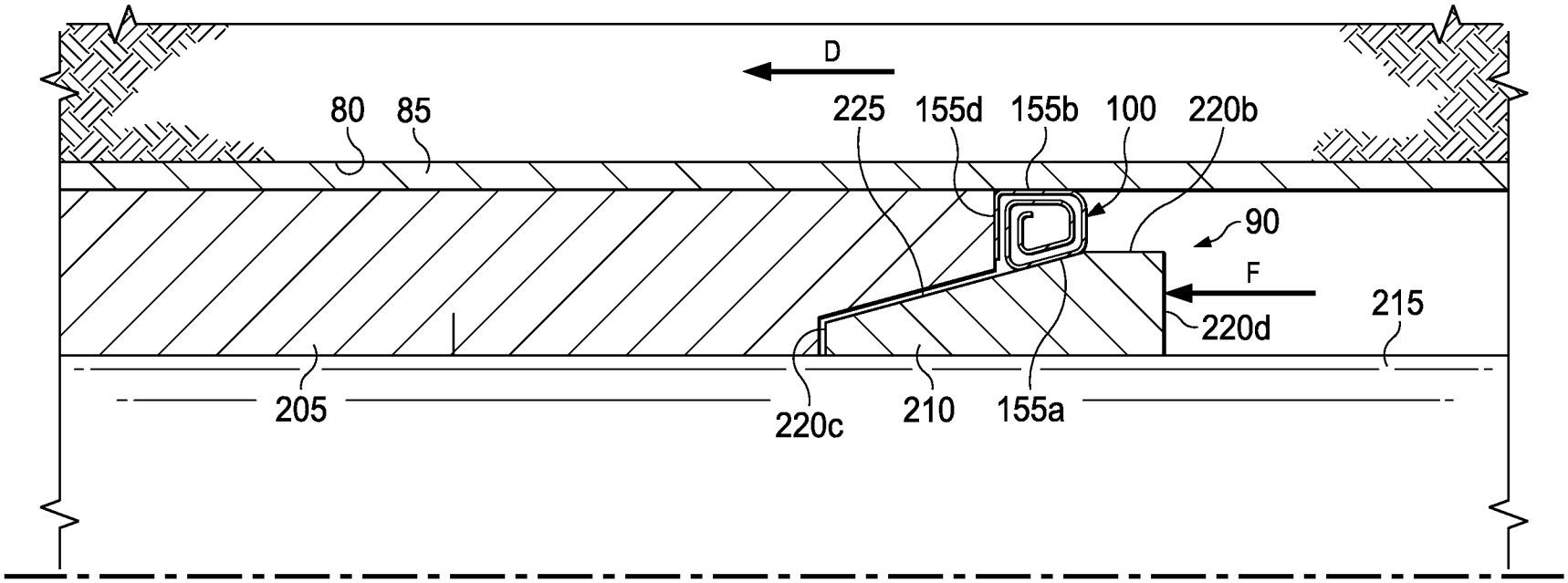
FIG. 6B is a cross-sectional view of the packer device of FIG. 1 in an expanded state or configuration, according to the another implementation of the packer device in which the packer device includes the backup ring shown in FIGS. 4A-4C.

Referring additionally to FIGS. 6B and 5B-2, with continuing reference to FIGS. 6A and 5A-2, in operation, after reaching its target depth, the packer device 90 is actuated from the unexpanded state or configuration to an expanded state or configuration, in which: the packing element 205 is expanded to engage the casing 85 (shown in FIG. 6B; or, alternatively, the packing element 205 may be expanded to engage an open-hole portion of the wellbore 80); the backup ring 100 has a radius R (shown in FIG. 5B-2), which radius R is larger than the radius r of the backup ring 100 when the packing device 90 is in the unexpanded configuration (shown in FIG. 5A-2); and the end portions 115*a* and 115*b* of the outer ring segment 105' telescopically receive and overlap the end portions 120*a* and 120*b*, respectively, of the inner ring segment 110' by an overlap angle β2 (shown in FIG. 5B-2), resulting in an overlap arc length A4 (the overlap angle β2 is smaller than the overlap angle β1 of the backup ring 100 when the packing device 90 is in the unexpanded configuration, and thus the overlap arc length A4 is also smaller than the overlap arc length A3).

As shown in FIG. 6B, to actuate the packer device 90 from the unexpanded state or configuration shown in FIGS. 6A and 5A-2 to the expanded state or configuration shown in FIGS. 6B and 5B-2, a setting force F is applied to the wedge ramp 210 to move the wedge ramp 210 in a direction D (i.e., towards the packing element 205) and relative to the mandrel 215. Although shown in FIG. 6B as being applied to the wedge ramp 210 to move the wedge ramp 210 in the direction D and relative to the mandrel 215, the setting force F may instead be applied to the packing device 90 in a different manner.

The end portion 220*c* of the wedge ramp 210 engages the packing element 205. The external tapered surface 225 of the wedge ramp 210 engages the radially-inward portion 155*a* of the backup ring 100 as the wedge ramp 210 moves in the direction D and relative to the mandrel 215. At the same time, the packing element 205 engages the end portion 155*d* of the backup ring 100, permitting the wedge ramp 210 to move in the direction D and relative to the backup ring 100. As the wedge ramp 210 moves in the direction D and relative to the backup ring 100, the backup ring 100 expands radially, that is, the radially-inward portion 155*a* of the backup ring 100 slides up the external tapered surface 225 of the wedge ramp 210, causing the end portions 120*a* and 120*b* of the inner ring segment 110' to telescope outwardly from the end portions 115*a* and 115*b*, respectively, of the outer ring segment 105', as shown in FIG. 5B-2, until the backup ring 100 reaches the end portion 220*d* of the wedge ramp 210 and the radially-outward portion 155*b* of the backup ring 100 engages the casing 85 (shown in FIG. 6B; or, alternatively, until the radially-outward portion 155*b* of the backup ring 100 contacts an open-hole portion of the wellbore 80).

During radial expansion, the backup ring 100 also experiences cross-sectional deformation (e.g., plastic deformation), allowing the backup ring 100 to be squeezed and held in place between the packing element 205, the wedge ramp 210, and the interior of the casing 85 (or the open-hole portion of the wellbore 80), filling the extrusion gap. When the wedge ramp 210 moves in the direction D, the wedge ramp 210 and the end portion 155*d* of the backup ring 100 engage the packing element 205, axially compressing and radially expanding the packing element 205 into engagement with the casing 85 (shown in FIG. 6B; or, alternatively, the packing element 205 may be expanded to engage an open-hole portion of the wellbore 80). During the radial expansion of the packing element 205, the radially-expanded backup ring 100 positioned at the end portion 220*d* of the wedge ramp 210 prevents, or at least reduces, extrusion of the packing element 205 by filling the extrusion gap between the wedge ramp 210 and the casing 85 (or the open-hole portion of the wellbore 80).

Figure 7:
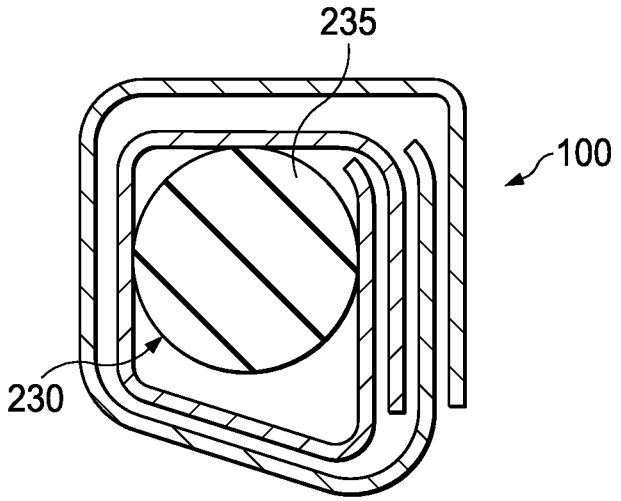
FIG. 7 is a cross-sectional view of yet another implementation of the backup ring taken along the line 7-7 of FIG. 2, according to one or more embodiments.
Figure 8:
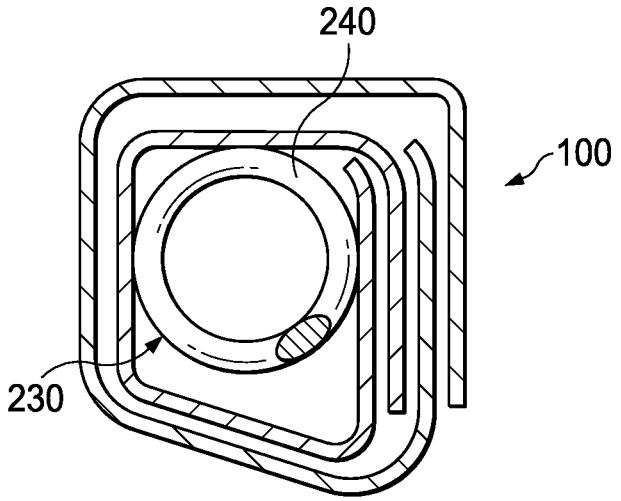
FIG. 8 is a cross-sectional view of yet another implementation of the backup ring taken along the line 8-8 of FIG. 2, according to one or more embodiments.

FIGS. 7 and 8 are a cross-sectional views of the backup ring 100 taken along the lines 7-7 and 8-8, respectively, of FIG. 2, according to yet another embodiment of the backup ring 100, which yet another embodiment of the backup ring 100 is substantially identical to the one embodiment of the backup ring 100 (shown in FIGS. 3A-3C; including the outer ring segment 105 and the inner ring segment 110), except that, in the yet another embodiment, the backup ring 100 includes an insert 230 extending interior to both the outer ring segment 105 and the inner ring segment 110.

Referring to FIG. 7, with continuing reference to FIGS. 3A-3C, in one implementation of the yet another embodiment of the backup ring 100, the insert 230 is or includes a central ring 235 made of an elastomeric material such as, for example, rubber. The central ring 235 may be arc-shaped (e.g., C-shaped) such that, at least when the backup ring 100 is expanded, the central ring 235 extends only part-way around the circumference of the backup ring 100. In one or more embodiments, the central ring 235 reduces the cross-sectional deformation of the backup ring 100 before, during, and/or after expansion of the backup ring 100, helping the backup ring 100 to prevent, or at least reduce, extrusion of the packing element 160 (or the packing element 205). In one or more embodiments, the central ring 235 is a rubber O-ring with a scarf cut. In one or more embodiments, the central ring 235 adds a desirable cross-sectional and circumferential load-carrying capacity to the backup ring 100, making installation of the backup ring 100 onto the packer device 90 easier.

Referring to FIG. 8, with continuing reference to FIGS. 3A-3C, in another implementation of the yet another embodiment of the backup ring 100, the insert 230 is or includes a spring 240, which spring 240 extends around the circumference of the backup ring 100 to thereby connect the outer ring segment 105 to the inner ring segment 110, and vice versa. In some embodiments, the spring 240 is a garter spring (e.g., an encapsulated garter spring). The spring 240 enhances the backup ring 100's ability to carry loads applied thereto by the packing element 160 (or the packing element 205), the wedge ramp 165 (or the wedge ramp 210), and/or the piston 170. In addition, similarly to the central ring 235, the spring 240 adds favorably cross-sectional and circumferential load-carrying capacity to the backup ring 100, making installation of the backup ring 100 onto the packer device 90 easier. For installation, the outer ring segment 105 and the inner ring segment 110 are placed apart first. Next, the spring 240 is inserted through both the outer ring segment 105 and the inner ring segment 110, and free ends of the spring 240 are connected to each other to form the spring 240 into a continuous circumferential component. The spring 240 then pulls the end portions 120*a* and 120*b* of the inner ring segment 110 telescopically into the end portions 115*a* and 115*b*, respectively, of the outer ring segment 105. The amount of overlap between the outer ring segment 105 and the inner ring segment 110 is dependent on the stretch of the spring 240 and can be engineered to fit a variety of design geometries.

As compared to conventional backup rings: the radial flexibility of the backup ring 100 provides improved deployment under low setting loads; the hollow cross section of the backup ring 100 provides improved cross-sectional flexibility, resulting in more continuous contact with the casing 85 (or the open-hole portion of the wellbore 80, which can have uneven surfaces) and thereby minimizing the risk of extrusion to the packing element 160 (or the packing element 205); the simple (e.g., no helix cut, no complex geometry, and no special connection required to achieve full deployment) and tolerance-friendly (i.e., the performance of the backup ring 100 is less sensitive to fabrication precision or tolerances) design of the backup ring 100 makes it more appealing for either conventional or additive manufacturing; predicting the full deployment and setting load of the backup ring 100 follows the classical mechanics of material and is less difficult to understand and analyze; the design of the backup ring 100 can be easily scaled and modified for different applications using a desirable hollow cross section without the need to restart the analysis and design cycle, including parametric studies and fabrication considerations; and the backup ring 100 is more reliable than conventional backup rings due to the minimum number of parts required and simplicity of design.

Although described herein in the context of a particular application, that is, as a part of the packer device 90, the backup ring 100 of the present disclosure can be readily adapted to a variety of other applications, including any application in which a conventional backup ring is typically used. Indeed, due to its design, the backup ring 100 is readily scalable to different design scenarios and projects with a quick turnaround in analytical simulations. As a result of the ease in fabricating the backup ring 100, production efficiency is enhanced as compared to conventional backup rings, that is, lead times are shorter because quality assurance (QA) and quality control (QC) follow a smooth process.

A method has been disclosed. The method generally includes radially expanding a backup ring to prevent, or at least reduce, extrusion of a sealing element, the backup ring including an inner ring segment and an outer ring segment, the inner ring segment defining opposing first and second end portions, and the outer ring segment defining opposing third and fourth end portions; wherein the third end portion of the outer ring segment telescopically receives, and overlaps, the first end portion of the inner ring segment; wherein radially expanding the backup ring includes sliding the backup ring up an external tapered surface of a wedge ramp; and wherein sliding the backup ring up the external tapered surface of the wedge ramp telescopes the first end portion of the inner ring segment outwardly from the third end portion of the outer ring segment. In one or more embodiments, the fourth end portion of the outer ring segment telescopically receives, and overlaps, the second end portion of the inner ring segment; and sliding the backup ring up the external tapered surface of the wedge ramp telescopes the second end portion of the inner ring segment outwardly from the fourth end portion of the outer ring segment. In one or more embodiments, sliding the backup ring up the external tapered surface of the wedge ramp includes: pushing, using a piston, the backup ring towards the sealing element and relative to the wedge ramp. In one or more embodiments, the sealing element and the wedge ramp are positioned around a mandrel; and the method further includes moving the wedge ramp axially relative to the mandrel and toward the sealing element to axially compress and radially expand the sealing element. In one or more embodiments, moving the wedge ramp axially relative to the mandrel and toward the sealing element includes: pushing, using a piston, the wedge ramp toward the sealing element.

An apparatus has also been disclosed. The apparatus generally includes: a wedge ramp defining an external tapered surface; and a backup ring positioned around the wedge ramp, wherein the backup ring includes: an inner ring segment defining opposing first and second end portions, and an outer ring segment defining opposing third and fourth end portions, wherein the third end portion of the outer ring segment telescopically receives, and overlaps, the first end portion of the inner ring segment, and wherein the backup ring is slidable up the external tapered surface of the wedge ramp to: radially expand the backup ring, and prevent, or at least reduce, extrusion of a sealing element. In one or more embodiments, the apparatus further includes: a piston positioned adjacent the wedge ramp and movable to slide the backup ring up the external tapered surface of the wedge ramp. In one or more embodiments, the apparatus further includes a mandrel around which the wedge ramp is positioned; wherein the wedge ramp is slidable relative to the mandrel and toward the sealing element to axially compress and radially expand the sealing element. In one or more embodiments, the apparatus further includes: a piston positioned around the mandrel adjacent the wedge ramp and movable to slide the wedge ramp relative to the mandrel and toward the sealing element. In one or more embodiments, the apparatus further includes the sealing element; wherein the sealing element is positioned around the mandrel. In one or more embodiments, the backup ring defines a radially-inward portion tapered to engage the external tapered surface of the wedge ramp. In one or more embodiments: the inner ring segment extends along a first arc length defined by a first central angle of greater than 180 degrees; and the outer ring segment extends along a second arc length defined by a second central angle of greater than 180 degrees. In one or more embodiments: the inner ring segment defines a first hollow cross section; and the outer ring segment defines a second hollow cross section.

A backup ring has also been disclosed. The backup ring generally includes: an inner ring segment defining opposing first and second end portions; and an outer ring segment defining opposing third and fourth end portion, wherein the third end portion of the outer ring segment telescopically receives, and overlaps, the first end portion of the inner ring segment, and wherein the backup ring is slidable up an external tapered surface of a wedge ramp to: radially expand the backup ring, and prevent, or at least reduce, extrusion of a sealing element. In one or more embodiments, radially expanding the backup ring telescopes the first end portion of the inner ring segment outwardly from the third end portion of the outer ring segment. In one or more embodiments, the fourth end portion of the outer ring segment telescopically receives, and overlaps, the second end portion of the inner ring segment; and radially expanding the backup ring telescopes the second end portion of the inner ring segment outwardly from the fourth end portion of the outer ring segment. In one or more embodiments, the backup ring defines a radially-inward portion tapered to engage the external tapered surface of the wedge ramp. In one or more embodiments: the inner ring segment extends along a first arc length defined by a first central angle of greater than 180 degrees; and the outer ring segment extends along a second arc length defined by a second central angle of greater than 180 degrees. In one or more embodiments: the inner ring segment defines a first hollow cross section; and the outer ring segment defines a second hollow cross section. In one or more embodiments, the backup ring further includes an insert extending within the first hollow cross section of the inner ring segment and the second hollow cross section of the outer ring segment.

It is understood that variations may be made in the foregoing without departing from the scope of the present disclosure.

In several embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several embodiments, while different steps, processes, and procedures are described as appearing as distinct acts, one or more of the steps, one or more of the processes, and/or one or more of the procedures may also be performed in different orders, simultaneously and/or sequentially. In several embodiments, the steps, processes, and/or procedures may be merged into one or more steps, processes and/or procedures.

In several embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. A method, comprising:

radially expanding a backup ring to prevent, or at least reduce, extrusion of a sealing element, the backup ring comprising an inner ring segment and an outer ring segment, the inner ring segment defining opposing first and second end portions, and the outer ring segment defining opposing third and fourth end portions;

wherein the third end portion of the outer ring segment telescopically receives, and overlaps, the first end portion of the inner ring segment;

wherein radially expanding the backup ring comprises sliding the backup ring up an external tapered surface of a wedge ramp;

wherein sliding the backup ring up the external tapered surface of the wedge ramp telescopes the first end portion of the inner ring segment outwardly from the third end portion of the outer ring segment; and wherein:

the inner ring segment defines a first hollow cross section, wherein the first hollow cross-section comprises an overlapping non-closed rectangular shape; and the outer ring segment defines a second hollow cross section, wherein the second hollow cross-section comprises an overlapping non-closed rectangular shape.

2. The method of claim 1, wherein the fourth end portion of the outer ring segment telescopically receives, and overlaps, the second end portion of the inner ring segment; and wherein sliding the backup ring up the external tapered surface of the wedge ramp telescopes the second end portion of the inner ring segment outwardly from the fourth end portion of the outer ring segment.

3. The method of claim 1, wherein sliding the backup ring up the external tapered surface of the wedge ramp comprises:

pushing, using a piston, the backup ring towards the sealing element and relative to the wedge ramp.

4. The method of claim 1, wherein the sealing element and the wedge ramp are positioned around a mandrel; and wherein the method further comprises moving the wedge ramp axially relative to the mandrel and toward the sealing element to axially compress and radially expand the sealing element.

5. The method of claim 4, wherein moving the wedge ramp axially relative to the mandrel and toward the sealing element comprises:

pushing, using a piston, the wedge ramp toward the sealing element.

6. The method of claim 1, wherein:

the first hollow cross-section further comprises a three disk shaped walls, one cylinder shaped wall, and one frustoconical shaped wall;

wherein the walls are constructed in a sequence of a first disk shaped wall, a first cylinder shaped wall, a second disk shaped wall, a first frustoconical wall, a third disk shaped wall; and wherein the first disk shaped wall overlaps the third disk shaped wall.

7. The method of claim 1, wherein:

the second hollow cross-section further comprises a three disk shaped walls, one cylinder shaped wall, and one frustoconical shaped wall;

wherein the walls are constructed in a sequence of a first disk shaped wall, a first cylinder shaped wall, a second disk shaped wall, a first frustoconical wall, a third disk shaped wall; and wherein the first disk shaped wall overlaps the third disk shaped wall.

8. The method of claim 1, wherein:

the first hollow cross-section further comprises five disk shaped walls, two cylinder shaped walls, and two frustoconical shaped walls;

wherein the walls are constructed in a sequence of a first disk shaped wall, a first cylinder shaped wall, a second disk shaped wall, a first frustoconical wall, a third disk shaped wall, a second cylinder shaped wall, a fourth disk shaped wall, a second frustoconical wall, and a fifth disk shaped wall; and wherein the first disk shaped wall is adjacent to the third disk shaped wall and third disk shaped wall is adjacent to the fifth disk shaped wall.

9. The method of claim 1, wherein:

the second hollow cross-section further comprises five disk shaped walls, two cylinder shaped walls, and two frustoconical shaped walls;

wherein the walls are constructed in a sequence of a first disk shaped wall, a first cylinder shaped wall, a second disk shaped wall, a first frustoconical wall, a third disk shaped wall, a second cylinder shaped wall, a fourth disk shaped wall, a second frustoconical wall, and a fifth disk shaped wall; and wherein the first disk shaped wall is adjacent to the third disk shaped wall and the third disk shaped wall is adjacent to the fifth disk shaped wall.

10. An apparatus, comprising:

a wedge ramp defining an external tapered surface; and a backup ring positioned around the wedge ramp, wherein the backup ring comprises:

an inner ring segment defining opposing first and second end portions, and an outer ring segment defining opposing third and fourth end portions, wherein the third end portion of the outer ring segment telescopically receives, and overlaps, the first end portion of the inner ring segment, and wherein the backup ring is slidable up the external tapered surface of the wedge ramp to:

radially expand the backup ring, and prevent, or at least reduce, extrusion of a sealing element, wherein:

the inner ring segment defines a first hollow cross section, wherein the first hollow cross-section comprises an overlapping non-closed rectangular shape; and the outer ring segment defines a second hollow cross section, wherein the second hollow cross-section comprises an overlapping non-closed rectangular shape.

11. The apparatus of claim 10, further comprising:

a piston positioned adjacent the wedge ramp and movable to slide the backup ring up the external tapered surface of the wedge ramp.

12. The apparatus of claim 10, further comprising a mandrel around which the wedge ramp is positioned;

wherein the wedge ramp is slidable relative to the mandrel and toward the sealing element to axially compress and radially expand the sealing element.

13. The apparatus of claim 12, further comprising:

a piston positioned around the mandrel adjacent the wedge ramp and movable to slide the wedge ramp relative to the mandrel and toward the sealing element.

14. The apparatus of claim 12, further comprising the sealing element;

wherein the sealing element is positioned around the mandrel.

15. The apparatus of claim 10, wherein the backup ring defines a radially-inward portion tapered to engage the external tapered surface of the wedge ramp.

16. The apparatus of claim 10, wherein:

the inner ring segment extends along a first arc length defined by a first central angle of greater than 180 degrees; and the outer ring segment extends along a second arc length defined by a second central angle of greater than 180 degrees.

17. A backup ring, comprising:

an inner ring segment defining opposing first and second end portions; and an outer ring segment defining opposing third and fourth end portion, wherein the third end portion of the outer ring segment telescopically receives, and overlaps, the first end portion of the inner ring segment, and wherein the backup ring is slidable up an external tapered surface of a wedge ramp to:

radially expand the backup ring, and prevent, or at least reduce, extrusion of a sealing element, wherein:

the inner ring segment defines a first hollow cross section, wherein the first hollow cross-section comprises an overlapping non-closed rectangular shape; and the outer ring segment defines a second hollow cross section, wherein the second hollow cross-section comprises an overlapping non-closed rectangular shape.

18. The backup ring of claim 17, wherein radially expanding the backup ring telescopes the first end portion of the inner ring segment outwardly from the third end portion of the outer ring segment.

19. The backup ring of claim 17, wherein the fourth end portion of the outer ring segment telescopically receives, and overlaps, the second end portion of the inner ring segment; and wherein radially expanding the backup ring telescopes the second end portion of the inner ring segment outwardly from the fourth end portion of the outer ring segment.

20. The backup ring of claim 17, wherein the backup ring defines a radially-inward portion tapered to engage the external tapered surface of the wedge ramp.

21. The backup ring of claim 17, wherein:

the inner ring segment extends along a first arc length defined by a first central angle of greater than 180 degrees; and the outer ring segment extends along a second arc length defined by a second central angle of greater than 180 degrees.

22. The backup ring of claim 17, further comprising an insert extending within the first hollow cross section of the inner ring segment and the second hollow cross section of the outer ring segment.

* * * * *